US007721698B2

(12) United States Patent
Tsunoda

(10) Patent No.: US 7,721,698 B2
(45) Date of Patent: May 25, 2010

(54) STARTER OF SMALL ENGINE

(75) Inventor: Shuhei Tsunoda, Suginami-ku (JP)

(73) Assignee: Starting Industrial Co., Ltd., Tokyo (JP)

( * ) Notice: Subject to any disclaimer, the term of this patent is extended or adjusted under 35 U.S.C. 154(b) by 137 days.

(21) Appl. No.: 11/921,791

(22) PCT Filed: May 17, 2006

(86) PCT No.: PCT/JP2006/309789

§ 371 (c)(1),
(2), (4) Date: Dec. 7, 2007

(87) PCT Pub. No.: WO2006/132061

PCT Pub. Date: Dec. 14, 2006

(65) Prior Publication Data

US 2009/0095246 A1 Apr. 16, 2009

(30) Foreign Application Priority Data

Jun. 8, 2005 (JP) ..... 2005-168684

(51) Int. Cl.
*F02N 1/00* (2006.01)
*F02N 3/00* (2006.01)
*F02N 11/00* (2006.01)

(52) U.S. Cl. ..... 123/179.24; 123/185.3

(58) Field of Classification Search ..... 123/179.24, 123/179.28, 185.14, 185.2, 185.3, 185.4, 123/185.5, 179.3; 74/9
See application file for complete search history.

(56) References Cited

U.S. PATENT DOCUMENTS

| | | | | |
|---|---|---|---|---|
| 2,042,841 | A * | 6/1936 | Harmon | 185/41 R |
| 5,163,392 | A * | 11/1992 | Morishima et al. | 123/179.25 |
| 5,537,966 | A | 7/1996 | Ohnishi | |
| 6,508,220 | B1 * | 1/2003 | Akaike et al. | 123/185.14 |

FOREIGN PATENT DOCUMENTS

| | | |
|---|---|---|
| JP | A 7-174061 | 7/1995 |
| JP | A 2001-65435 | 3/2001 |
| JP | A 2002-227753 | 8/2002 |
| JP | A 2003-247477 | 9/2003 |
| JP | A 2004-68639 | 3/2004 |
| JP | A 2004-108284 | 4/2004 |

* cited by examiner

*Primary Examiner*—Stephen K Cronin
*Assistant Examiner*—Anthony L Bacon
(74) *Attorney, Agent, or Firm*—Oliff & Berridge, PLC

(57) ABSTRACT

Energy is stored in the horse power spring to surely start the engine. The stopper having the engaging engageable with the end behind the rotation direction of the cam plate depressed area is arranged at near the cam plate which is integrally formed with pulley fixed to the engine crank shaft and has the depressed area o the disk rim, and the urging means supporting the stopper in a movable manner to the engaging position where the engaging engages with the depressed area and toe the avoidance position for avoiding the rim of cam plate, and normally urging to move the stopper to the avoidance position, on the other hand, enabling the stopper to move to the engaging position from the outside, and urging not to move the stopper to the avoidance position until a sufficient rotation load is added to the cam plate at the engaging position is provided.

4 Claims, 8 Drawing Sheets

STARTER OF SMALL ENGINE

BACKGROUND

This invention relates to an ignition system for small engines which may give sufficient horse power to a horse power spring for engine rotation, by providing a torque limiter with the current ignition systems.

Generally, a small engine ignition system has a drive gear which connects to a tubular cam having a nail engaging to a centrifugal latchet of a pulley fixed to the engine crankshaft with a horse power spring. This drive gear is rotated manually or by an electric motor to store energy in the horse power spring, when the energy exceeds the start resistance, the sudden release of the horse power spring starts the engine.

SUMMARY

Problems Resolved by the Invention

If the energy exceeding the start resistance is then stored in the horse power spring, the engine may be rotated by the horsepower of the horse power spring.

However, the start resistance of the engine is at its highest when the piston is at near the top dead center, and at its lowest when the piston is at near the bottom dead center; thus, the start resistance of the engine is unstable. Before enough horsepower is given to the horse power spring and/or sufficient energy is stored, the engine may start to rotate. In this case, the engine may not surely start.

This invention will solve the problems above and the purpose of the invention is to provide an ignition system for small engines that will enable the engine to surely start by giving enough horsepower to the horse power spring, regardless of the resistance.

Means to Resolve the Problem

In order to solve these problems, the invention defined as claim 1 is comprised of; the inside of the starter motor, a cylindrical cam having a cam nail which engages with a pulley centrifugal latchet fixed on the engine crank shaft, and a drive gear connecting to the cylindrical cam via a horse power spring located on the same axis;

a stopper being arranged near a cam plate which is integrally formed with the pulley, and having an engageable engaging with the end part behind the rotation direction of the cam plate depressed area;

urging means supporting the stopper in movable manner to an engaging position where the engaging engages with the depressed area and to an avoidance position for avoiding the cam plate rim, and normally urging to move the stopper to the avoidance position, on the other hand enabling the stopper to move the engaging position from outside, and urging not to move the stopper to the avoidance position until a sufficient rotation load is added to the cam plate at the engaging position.

The Ignition system for small engines as defined in claim 2 is comprised of; the first spring supporting the stopper in a swinging manner to the spindle provided in the starter case, and, around the spindle on both sides of the stopper, urging the stopper to swing to the avoidance position;

the second spring urging the stopper to swing to the engaging position;

enabling to move the stopper to the engaging position by pulling the second spring from the outside.

The ignition system for small engines as defined in claim 3 is comprised of; operation means which pulls the second spring from outside enabling operation of the start button of the engine self starter motor.

The invention defined as claim 4 is comprised of; a long hole being provided in the stopper and a spindle provided in the starter being engaged with the long hole so as to retract the stopper from the engaging position and move to the avoidance position.

EFFECTS OF THIS INVENTION

According to the invention defined in claim 1, since the start resistance of the engine and rotational resistance due to a stopper are added to the cam plate during ignition of the engine, sufficient energy is stored in the horse power spring due to the drive gear rotation. Since the engine is rotated releasing sufficient energy, the engine can surely tart.

According to the invention defined in claim 2, the stopper quickly moves between an avoidance position and an engaging position with the first and second springs. The movement operation is also easy.

According to the invention defined in claim 3, the stopper movement and self starter motor start can be performed by single operation. This makes for an efficient operational system.

According to the invention defined in claim 4, the stopper may smoothly retract from the engaging position.

DETAILED DESCRIPTION OF EMBODIMENTS

Figure 1:
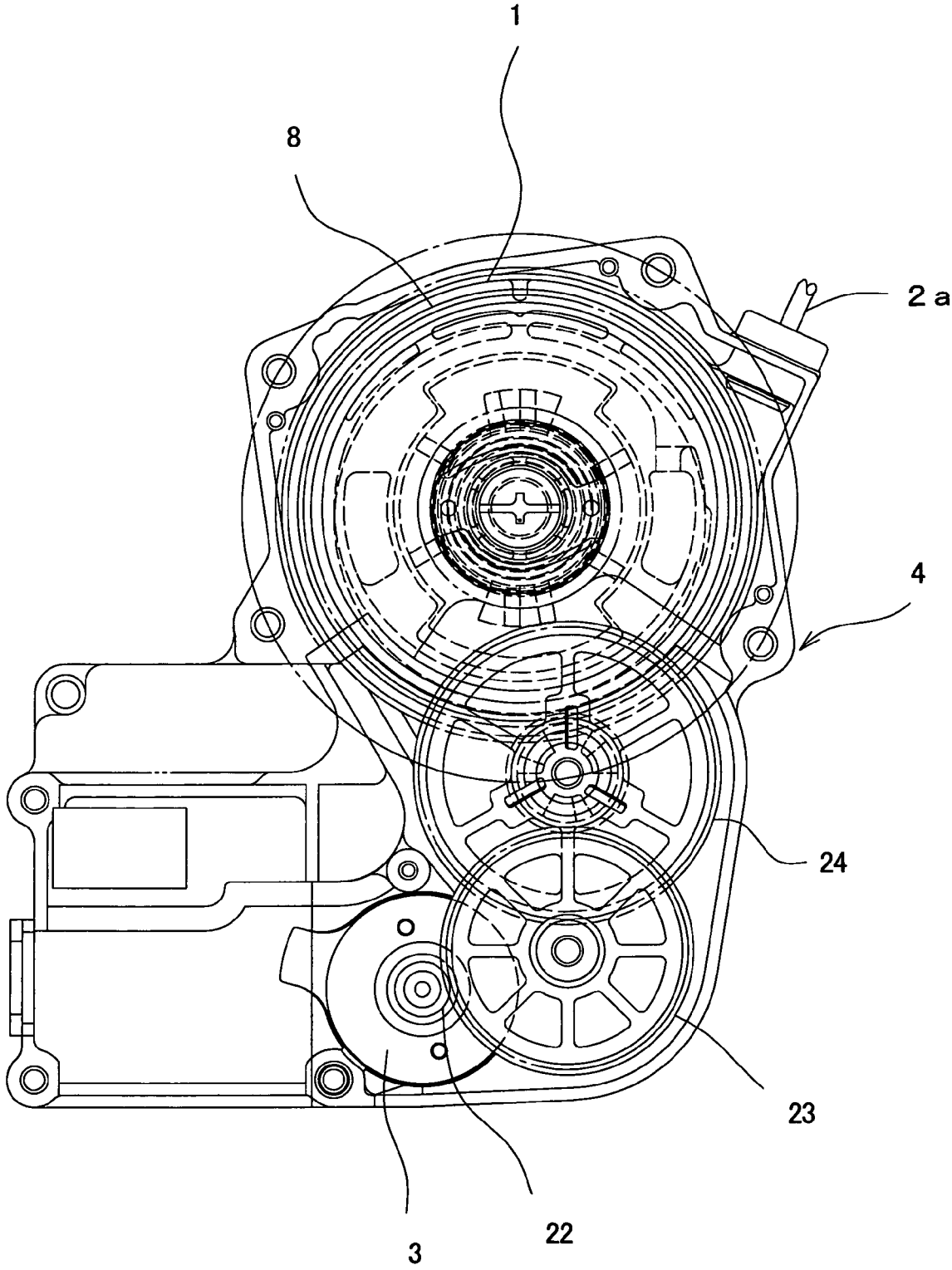
FIG. 1 shows a front view of the starter of the present invention.
Figure 2:
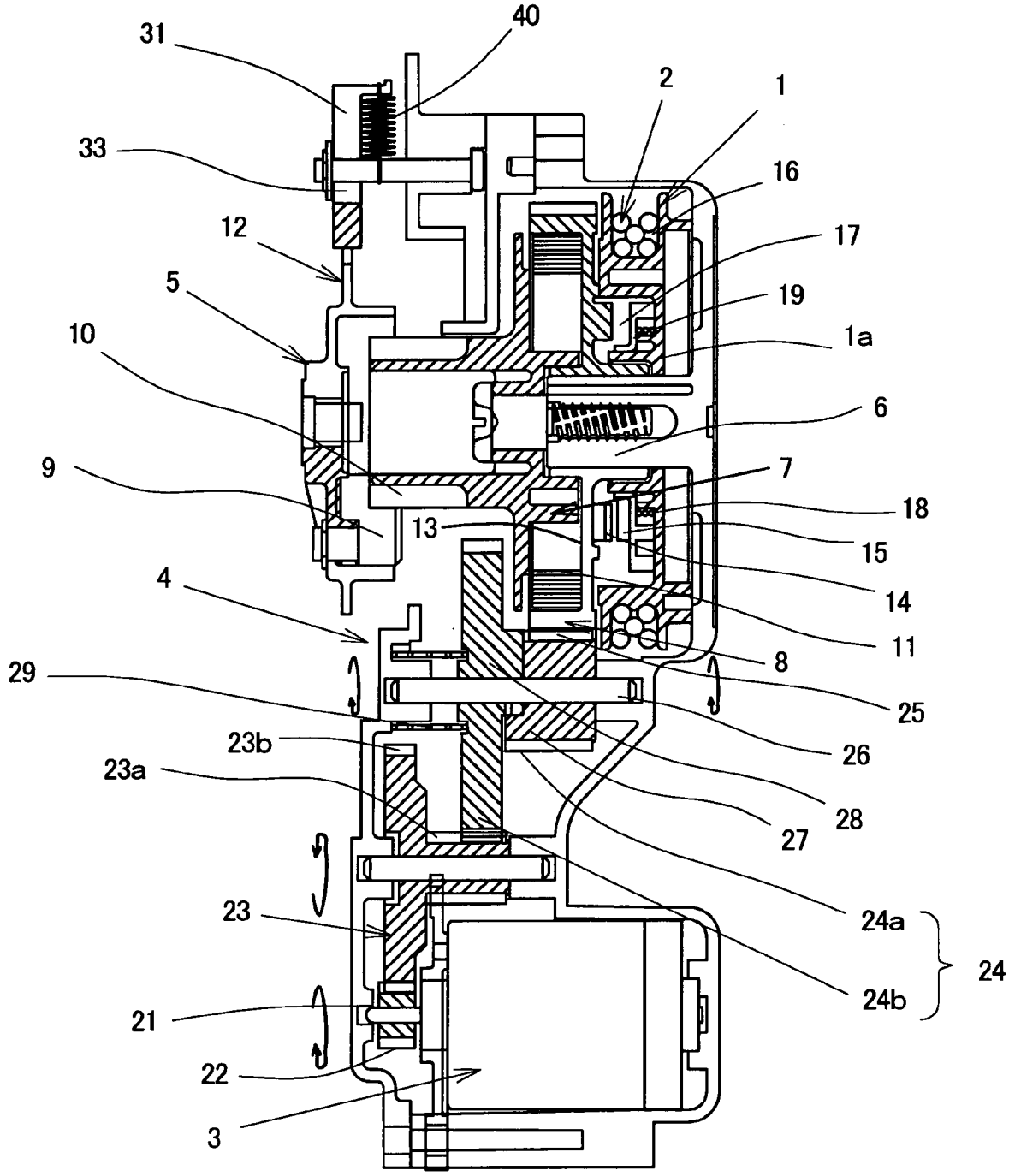
FIG. 2 shows a vertical cross-section drawing of the starter.

Hereinafter, embodiments of the present invention will be described with reference to the drawings. In FIG. 1 and FIG. 2, the ignition system for small engines is a combination of a recoil starter towing the starter rope 2 which is wound around the rope reel 1 and an electric self starter motor 3, the pulley 5 fixed to the engine crank shaft is installed on one side of the starter case 4, a spindle 6 is formed on the same axis of the pulley 5 in the starter case 4 and a cylindrical cam 7 engageable with the pulley 5 and a drive gear 8 which connects to the cylindrical 7 via a horse power spring 11 (spiral spring) are arranged in a freely rotating manner.

The cam plate 12 is integrally formed on the periphery of pulley 5.

The cam 7 is arranged on the pulley 5 side of the drive gear 8, and the cam nail 10 formed on the cam 7 is arranged oppositely to latch with the centrifugal latchet 9 provided on the side surface of pulley 5. The centrifugal latchet 9 is urged to always latch with the cam 7 with a spring. Consequently, similarly to the patent publication 1 mentioned earlier, when the cam 7 rotates in one direction, a pulley 5 also rotates since the centrifugal latchet 9 and the cam nail 10 engage with each other, and when the cam 7 rotates in the opposite direction, the cam idles so that the pulley 5 does not rotate. When rotation of the pulley 5 rotates the engine, and the rotation of the engine rotates the pulley 5, the centrifugal latchet 9 rotates in the direction that unlatches the centrifugal latchet 9 from the cam nail 10 due to centrifugal force, so that rotation transfer with the cam 7 of the engine is blocked.

A cyclic depressed area 13 is formed on the cam 7 side of the gear of drive gear 8 and the horse power spring 11 is arranged in the cyclic depressed area 13. One end of horse power spring 11 latches onto the drive gear 8 and the other end of the horse power spring 11 latches onto the cam 7. Thus, when the drive gear 8 rotates, the horse power spring 11 is wound and the rotary force is stored in the horse power spring 11, and when sufficient horsepower is stored, the cam 7 starts to rotate. The nails 14 and 15 are formed on the side surface of the opposite side of cam 7 of the drive gear 8.

The recoil start and the motor start are structured so as to rotate the drive gear 8.

The rotation transfer mechanism with its recoil start works in the follow manner; the rope reel 1 is supported in a freely rotating manner at the opposite side of the cam 7 on the spindle 6 of the drive gear 8. The rope groove 16 is formed on the periphery of the rope reel 1, and the disk area 17 is formed on the inner periphery. The starter rope 2 is wound in the rope groove 16, one end of the starter cord 2*a* is pulled outside of the starter case 4 and end of a base side is fixed at the rope reel 1 being pulled outside of the bottom hole (not shown) of the groove 16 to prevent it from coming off. By pulling the one end of the starter cord 2*a*, the starter rope 2 is pulled out from the rope reel 1 and the rope reel 1 rotates and drives around a reel spindle 6. In the disc store 17, a disk 19 which is equipped with the latchet nail 15 attaching and detaching to the latchet nail 14 of the drive gear 8 is provided in a movable manner, and is urged to always engage with the ratchet nail 14 of the drive gear with a compressive spring 18. The disk 19 is provided in a movable manner along a cylindrical part 1*a* of inner periphery of the rope reel 1.

Next, the mechanism of rotation transfer to the drive gear 8 with the self starter motor 3 is composed of two reducing gears. That is, the first reducing gear 23 is meshed and connected to the gear 2 of the self starter motor 3 (driven by a battery) output shaft 21, the second reducing gear 24 is meshed and connected to small-diameter gear 23*a* of the fist reducing gear 23, and the second reducing gear 24 meshes with the periphery gear 25. The second reducing gear 24 meshing with the drive gear 8 is divided into the small-diameter gear 24*a* and large-diameter gear 24*b*, and both gears are supported in a freely rotating manner on the common rotation axis 26. The small-diameter 24*a* meshes with the drive gear 8, and the large-diameter gear 24*b* meshes with the small-diameter gear 23*a* of the reducing gear 23. The large-diameter gear 24*b* moves along the rotation axis 26 and is arranged in a detachable manner to the small-diameter 24*a*.

Figure 3:
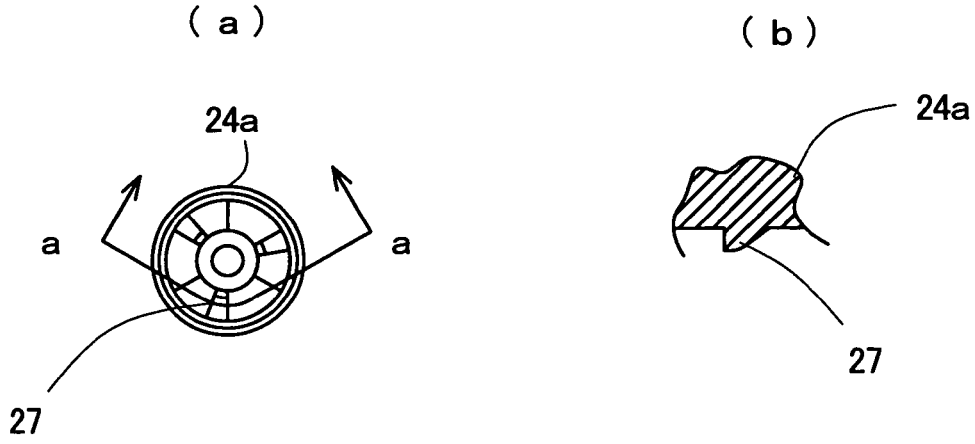
FIG. 3(*a*) and (*b*) show the front view of the small-diameter gear and cross-section drawing of a-a line respectively.
Figure 4:
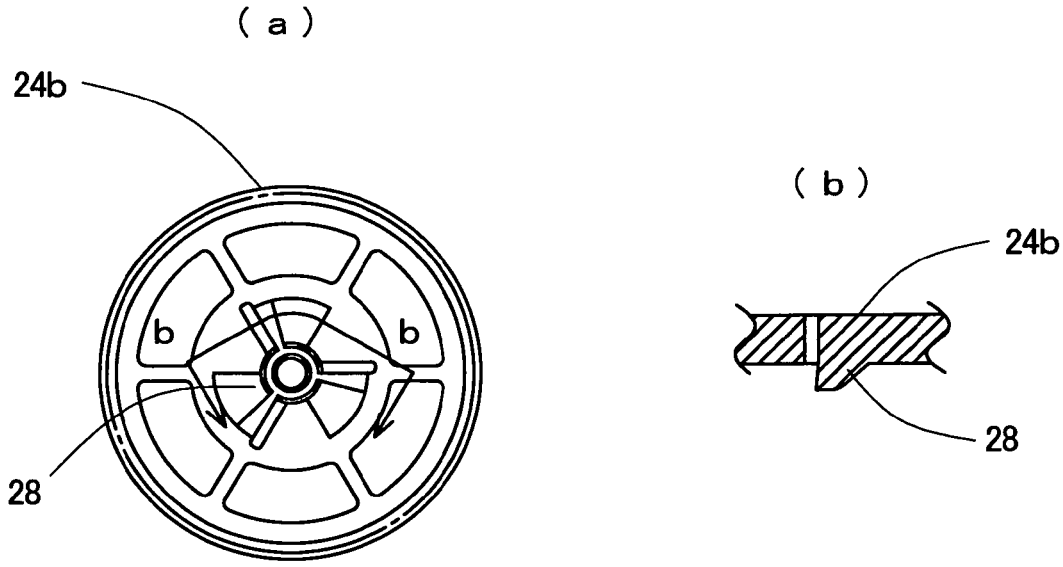
FIG. 4(*a*) and (*b*) show the front view of small-diameter gear and cross-section drawing on b-b line respectively.
Figure 5:
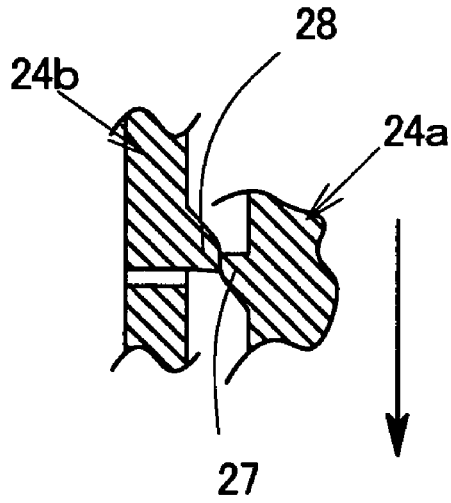
FIG. 5 is a cross-section diagram which shows nails of small-diameter gear and large-diameter ear engages with each other.
Figure 6:
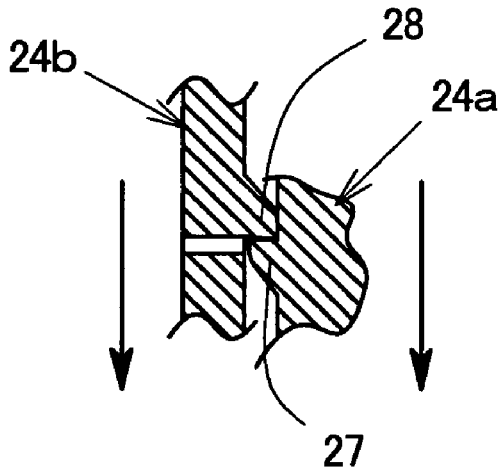
FIG. 6 is a cross-section diagram which shows nails of small-diameter gear and large-diameter gear do not engage with each other.

On the side surface, facing the small-diameter gear 24*a* and the large-diameter gear 24*b* each other, three engaging nails 27 and 28 are formed respectively. As shown in FIGS. 3 (*a*), (*b*) and FIGS. 4 (*a*), (*b*), one side of the circumferential direction of each engaging nail (27) and (28) is inclined and the other side is formed vertically against the side surface. As shown in FIG. 5, when engaging nails 27 and 28 rotate in the same direction, they engage each of their vertical surfaces and both gears rotate, and when the engaging nails rotate in the opposite direction, as shown in FIG. 6, each inclined surface abuts, not engages, and either of the gears idles. The compressive spring 29 is arranged between the starter case 4 and large-diameter gear 24*b*, the large-diameter is pressed toward the small-diameter gear 24*a* by the compressive spring 29, and the side surface of the large-diameter gear 24*b* and the small-diameter gear 24*a* is urged to contact to each other.

Figure 7:
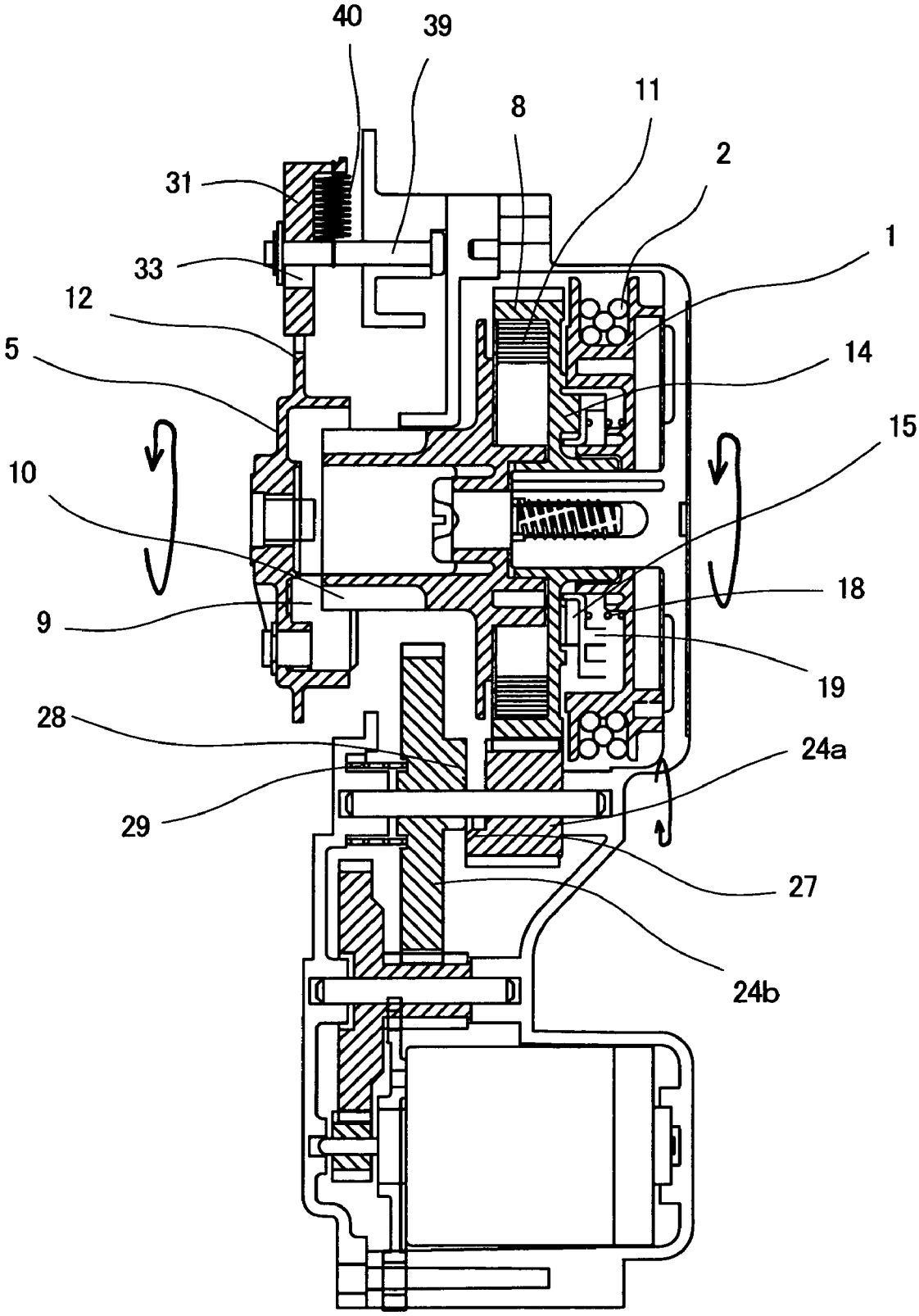
FIG. 7 is a vertical cross-section diagram of the starter during recoil start.
Figure 8:
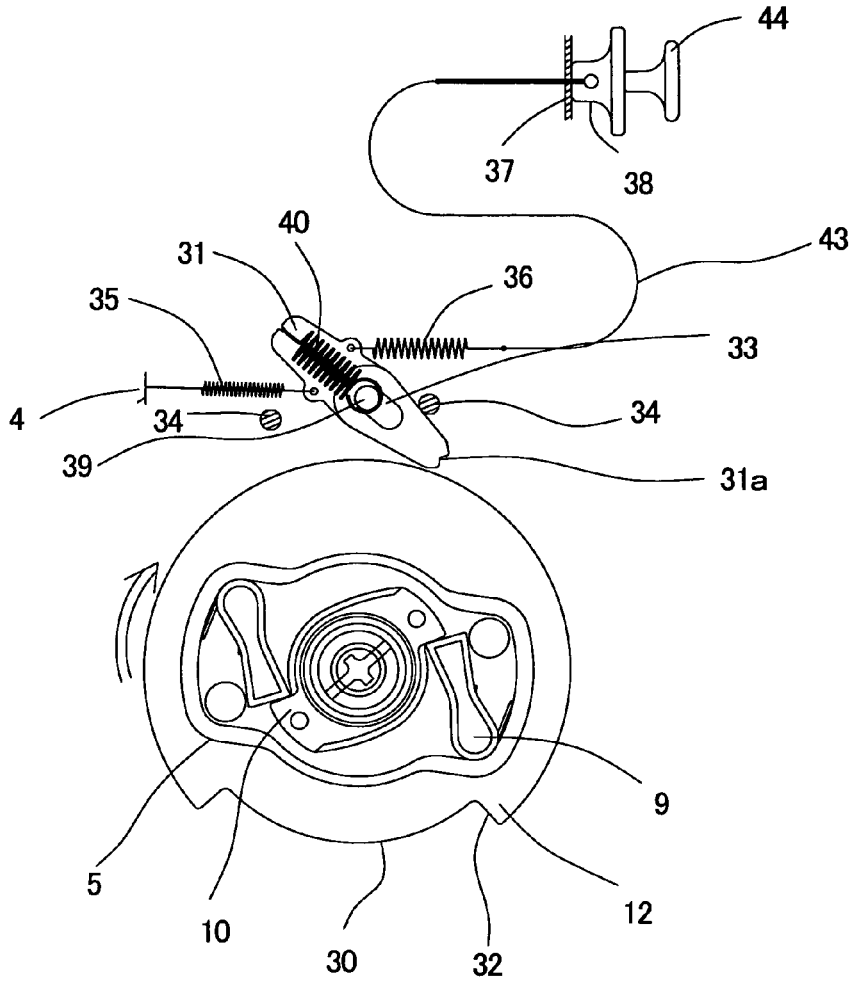
FIG. 8 is an illustration viewed from the front which shows the status where the stopper is at the avoidance position against the cam plate.

As shown in FIG. 7 and FIG. 8, the cam plate 12 which is integrally formed with the pulley 5 is comprised of having a depressed area 30 formed on the rim of the disk, and the stopper 31 is arranged near the cam plate 12. The stopper 31 is an elongated plate-like body, has an engageable engaging 31*a* at the end 32 (engaging end) behind the rotation direction of the cam plate 12 depressed area 30, a long hole 33 is also created at the center of the stopper 31, and the spindle 39 provided in the ignition case 4 engages with the long hole 33.

The stopper 31 may swing around the spindle 39, an engaging pin 34 is provided on both sides of the stopper 31 of the starter case, and the stopper 31 may swing until the stopper 31 engages with the pin 34. That is, the stopper 31 is supported in a swinging manner to the avoidance position (the position shown in FIG. 8) where the engaging 31*a* avoids the rim of the cam plate 12 and the engaging position (the position shown in FIG. 8) where the engaging 31*a* engages with the engaging end 32 of the cam plate.

On the both sides of the stopper 31, the first spring 35 which urges the stopper 31 to swing to the avoidance position and the second spring 36 which urges the stopper 31 to swing to the engaging position are arranged. The stopper 31 is urged to move to the avoidance position where the engaging 31*a* does not engage with the engaging end 32 of the cam plate 12 with the first spring 35.

The end of the first spring 35 is fixed to the starter case 4, and the second spring 36 end is installed in the limiter button 38 (operation means) installed outside of the wall 37 of the starter case 4 via the wire 43. The limiter button 38 is installed detachably from the wall 37, pulling the limiter button 38 pull the second spring 36, and the stopper 31 may swing to the engaging position against the first spring 35.

Next, the third spring 40 (urging means) is arranged at the end of the opposite side of the engaging 31*a* of the spindle 39 and the stopper 31. Thus, within the area where the both ends of the long hole 33 engages with the spindle 39, the stopper 31 is arranged in a movable manner to the position where the engaging 31*a* engages with the engaging end 32 of the cam plate, and the retracting position (the position shown in FIG. 12) where the engaging 31*a* retracts from the engaging position and the engaging is released. The retracting is performed with the stopper engaged with the cam plate when sufficient rotation resistance is added to the cam plate and the cam plate cannot bear the load, and the stopper moves to the avoidance position with the first spring.

Figure 9:
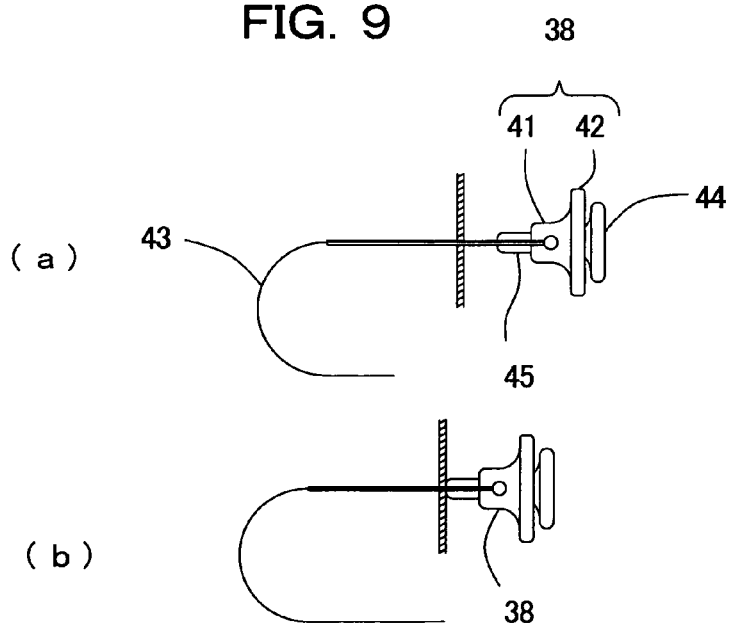
FIG. 9(*a*) and (*b*) show operation function of the limiter button and the motor start button.

The limiter button 38, as shown in FIG. 9 (*a*), has a guard 42 on one side of the cylindrical part 41 and one end of the wire 43 is fixed to the cylindrical part. Inside the cylindrical part 41, the axis 45 of the start button 44 for the self starter motor is fitted in a swinging manner. Hence, according to the switch button structure, conditions can be divided into four categories; when the limiter button 38 and the motor starter button 44 are pulled (as shown in FIG. 9(*a*)), or when only the limiter button 38 is pulled (as shown in FIG. 9(*b*)), or when neither of the limiter button 38 nor the motor starter button 44 is pulled (as shown in FIG. 8).

Next, operation function of the ignition system with the said structure is explained.

When the engine is started with the self starter motor 3, as shown in FIG. 9 (*a*), the limiter button 38 and the motor start button 44 are pulled. With the operation of the motor start button, as shown in FIG. 2, electricity is supplied from a battery to the self starter motor 3, and the rotary force is transmitted to the large-diameter gear 24*b* of the second reducing gear 24 from the gear 22 fixed on the output shaft 21 through the first reducing gear 23. Since the large-diameter gear 24*b* is pressed against the small-diameter 24*a* with a compressive spring 29 and when the large-diameter gear 24*b* rotates, in the direction shown in FIG. 2, engaging nails of the small-diameter gear 24*a* and the large-diameter gear 24*b* engage with each other; hence, the small-diameter gear 24*a* rotates, the rotary force is transmitted to the drive gear 8 and the drive gear 8 rotates. When the drive gear 8 rotates, the load to the cam 7 becomes large since the rotation resistance increases due to the engine start resistance, the horse power spring 11 is wound and fasten. Since the engine rotation resistance is small at first, when a sufficient amount of energy is stored in the horse power spring 11, the cam rotates and the cam plate 12 integrally formed with the pulley 5 rotates via the centrifugal latchet 9.

Figure 10:
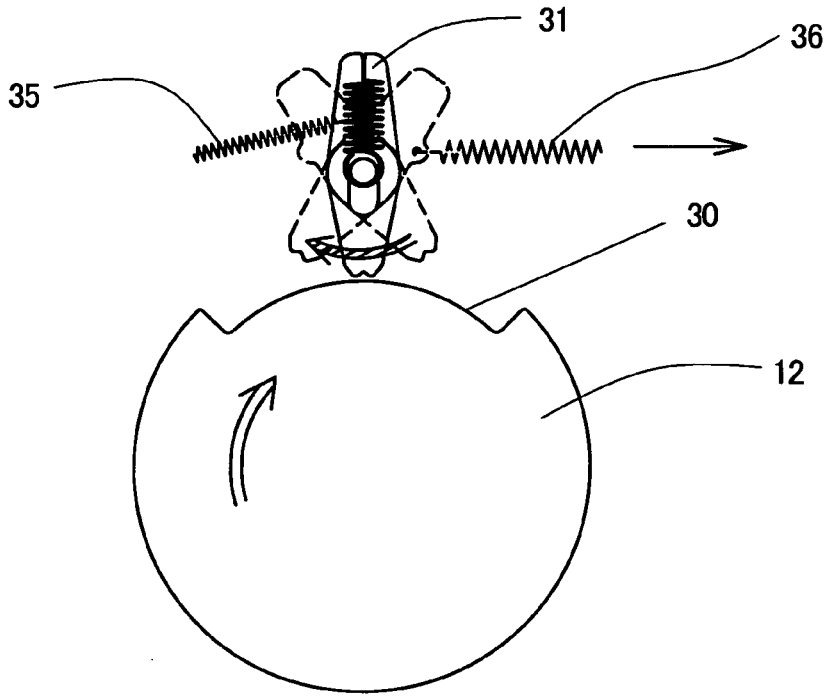
FIG. 10 is an illustration which shows the stopper is moving to the engaging position.
Figure 11:
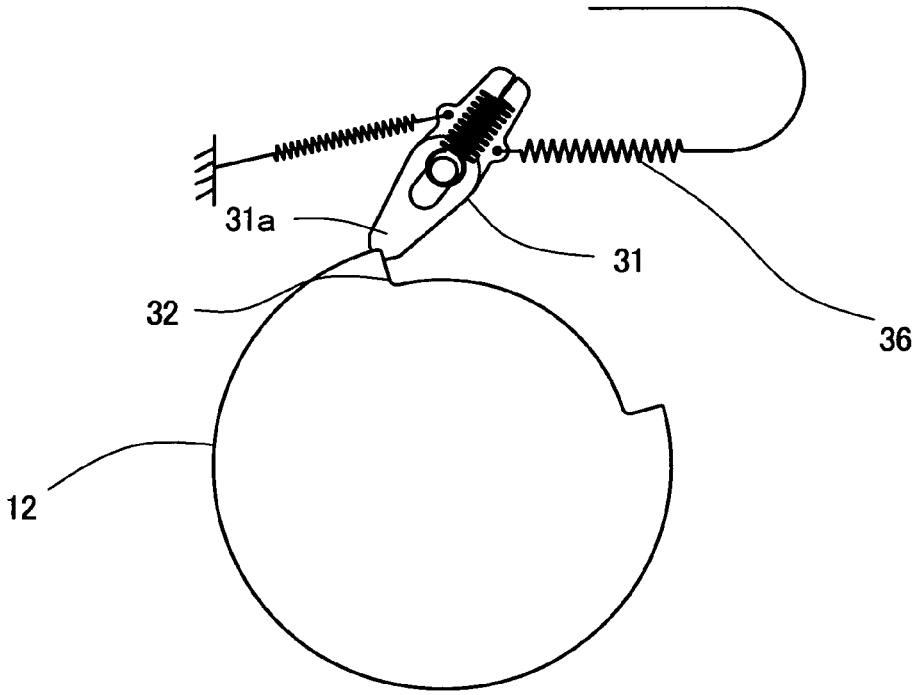
FIG. 11 is an illustration whish shows the stopper in the engaging position.

With the operation of the limiter button 38, in addition to the engine start resistance, rotation resistance of the cam plate 12 with the stopper 31 is also added to the cam. That is, by pulling the limiter button 38, as shown in FIG. 10, spring power of the second spring 36 becomes larger than that of the first spring 35, and the stopper is urged to swing toward the right rotation direction of the figure. In this situation, after the self starter motor start button is turned on as stated above, as stated above, when the cam plate 12 rotates and the depressed area 30 passes through the stopper 31, the stopper 31 quickly swings to the engaging position as shown in FIG. 11 through the status as shown in FIG. 10, and the engaging 31*a* of the tip end of the stopper 31 with the engaging 32 behind the depressed area 30 of the cam plate 12; hence, the cam plate 12 stops since the rotation resistance due to the stopper 31 is added. The engine rotation also stops. This stop position is at the compression top dead center of the piston, and the position almost matches with the position where the rotation resistance is at maximum when the air-fuel mixture is compressed.

Figure 12:
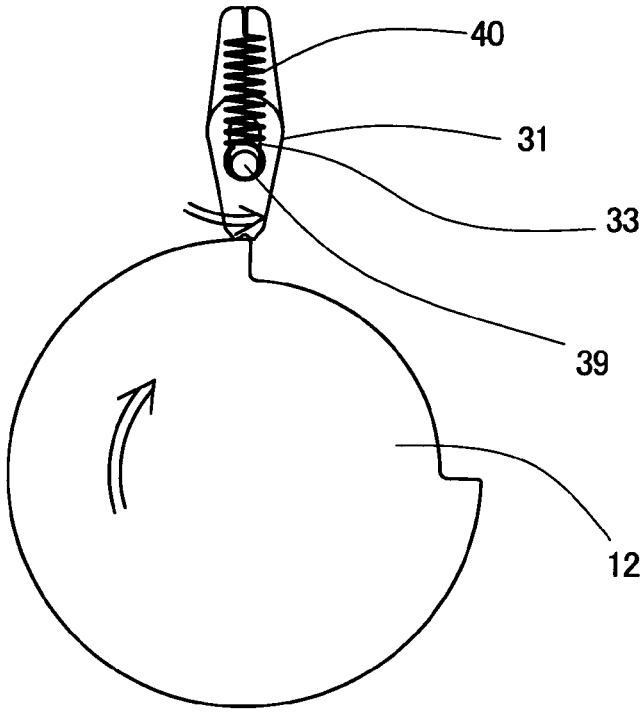
FIG. 12 is an illustration which shows the stopper is pushed out from the engaging position and retracts.
Figure 13:
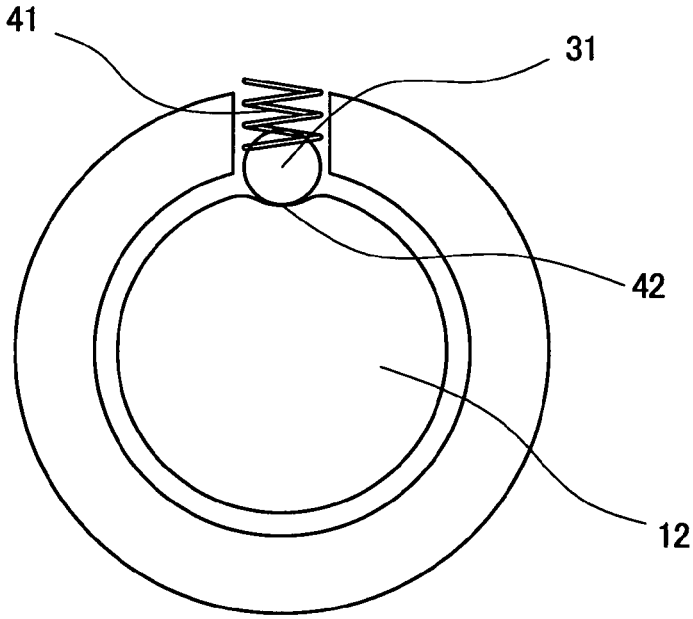
FIG. 13 is a simplified illustration which shows another example of the cam plate and the stopper.

Since the self starter motor 3 continues rotating, the drive gear 8 also continues rotating and the horse power spring 11 is more strongly wound and fastened; hence, the rotary force from the cam to the cam plate 12 increases. When the energy stored in the horse power spring 11 exceeds the rotation resistance against the cam plate 12, which is the sum of the engine rotation resistance and rotation deterrent force, the stopper 31 cannot resist the load, and, as shown in FIG. 12, the stopper retracts against the spring power of the spring 40 and moves to the initial position as shown in FIG. 8 by being swung by the first spring 35. When the stopper 31 comes off from the cam plate 12, the energy stored in the horse power spring is released suddenly, the cam 7, the cam plate 12 and the pulley 5 rotate, and the engine connected to the pulley 5 starts to rotate at high speed.

When the drive gear 8 rotates as described above, in the rotation direction, as shown in FIG. 2 and FIG. 5, each inclined surface of the latchet nail 14 of the drive gear 8 and the latchet nail 15 of the disk 19 of the rope reel 1 contact, the nails override against the compressive spring 18, the nails do not engage and are separated; rotary force of the drive gear 8 is not transmitted to the rope reel 1.

Next, when the engine is started with the recoil start, as shown in FIG. 9 (*b*), only the limiter button 38 is pulled, a starter rope 1 is dragged to rotate the rope reel 1. As shown in FIG. 7, since the latchet nail 15 of the disk 19 and the latchet nail 14 of the drive gear 8 are urged to engage with each other with the compressive spring 18, the drive gear 8 rotates. When the drive gear 8 rotates, as described above, energy is stored in the horse power spring 11, the energy is then released suddenly, the cam 7, the cam plate 12, and the pulley 5 rotate, simultaneously, the engine connected to the pulley 5 rotates at high speed and starts to run.

When the engine starts with the recoil start, the drive gear 8 rotates, this rotation is transmitted to the small-diameter gear 24*a* of the second reducing gear 24; hence the small-diameter gear 24*a* rotates. However, in the case of this rotation direction, as shown in FIG. 5 and FIG. 7, each inclined surface of the engaging nails 27 and 28 of the small-diameter gear 24*a* and large-diameter gear 24*b* contact and override, so that the nails 27 and 26 cannot engage with each other. Because of the reduction rate, since the torque which rotates the large-diameter gear 24*b* is greater than the spring power of the compressive spring 29, the large-diameter gear 24*b* is locked and moves on a rotation axis 26 to secede from the small-diameter gear 24*a* against the compressive spring 29; hence, only the small-diameter 24*a* idles and the rotary force of the drive gear 8 is not transmitted to the large-diameter gear 24*b*.

As stated above, to start the engine, the start resistance and rotation resistance due to the stopper 31 are added to the cam plate 12; hence energy is sufficiently stored due to the rotation of the drive gear 8 in the horse power spring 11, which surely start the engine.

The self starter motor start or the recoil start is selectively performed in the above example. However, this invention is not limited to the examples. Either start method can be applied.

The stopper adding the rotation resistance to the cam plate is not limited to the mentioned above. For example, the structure, a spring 41 engages a spherical shape to the depressed area 42 of the cam plate 12, may be applied.

The invention claimed is:

1. The ignition system for small engines is comprised of:

an inside of a starter case, a cylindrical cam having a cam nail which engages with a pulley centrifugal latchet fixed on an engine crank shaft, and a drive gear connecting to the cylindrical cam via a horse power spring located on the same axis;

a stopper being arranged near a cam plate which is integrally formed with the pulley, and engaging with an end part behind the rotation direction of a cam plate depressed area;

an urging element that supports the stopper in a movable manner to an engaging position to engage with the depressed area and to an avoidance position for avoiding a cam plate rim, and normally urging the stopper to the avoidance position, on the other hand enabling the stopper to move to the engaging position from outside, and urging the stopper not to move to the avoidance position until a sufficient rotation load is added to the cam plate at the engaging position;

a first spring supporting the stopper in a swinging manner to a spindle provided in the starter case, and, around the spindle on both sides of the stopper, urging the stopper to swing to the avoidance position;

a second spring urging the stopper to swing to the engaging position to enable the stopper to move to the engaging position by pulling the second spring from the outside.

2. The ignition system for small engines as defined in claim 1 is comprised of:

an operation device which pulls the second spring from outside enabling operation of a start button of an engine self starter motor.

3. The ignition system for small engines as defined in claim 1 is comprised of:

a long hole being provided in the stopper and a spindle provided in the starter being engaged with the long hole so as to retract the stopper from the engaging position and to move to the avoidance position.

4. The ignition system for small engines as defined in claim 1 is comprised of:

a long hole being provided in the stopper and a spindle provided in the starter being engaged with the long hole so as to retract the stopper from the engaging position and to move to the avoidance position.

* * * * *

UNITED STATES PATENT AND TRADEMARK OFFICE

CERTIFICATE OF CORRECTION

PATENT NO. : 7,721,698 B2
APPLICATION NO. : 11/921791
DATED : May 25, 2010
INVENTOR(S) : Shuhei Tsunoda It is certified that error appears in the above-identified patent and that said Letters Patent is hereby corrected as shown below:

Title Page, Item (75)
Please correct the Inventor's city from "Suginami-ku" to "Tokyo," as shown below.

(75) Inventor: Shuhei Tsunoda, ~~Suginami-ku (JP)~~ Tokyo (JP)

Signed and Sealed this

Twenty-fourth Day of August, 2010

David J. Kappos

David J. Kappos
*Director of the United States Patent and Trademark Office*